United States Patent [19]

Patterson

[11] Patent Number: 4,839,647

[45] Date of Patent: Jun. 13, 1989

[54] ILLUMINATED TRAFFIC SIGNAL FOR COLOR BLIND PERSONS

[76] Inventor: R. Gordon Patterson, 233 N. Val Vista Dr.; sp. 563, Mesa, Ariz. 85203

[21] Appl. No.: 153,445

[22] Filed: Feb. 8, 1988

[51] Int. Cl.[4] ..... G08G 1/095

[52] U.S. Cl. ..... 340/907

[58] Field of Search ..... 340/907, 84, 107; 40/546, 564

[56] References Cited

U.S. PATENT DOCUMENTS

| | | | |
|---|---|---|---|
| D. 85,143 | 9/1931 | Addler, Jr. . | |
| D. 114,864 | 5/1939 | Muir . | |
| D. 159,259 | 7/1950 | Ferguson . | |
| D. 200,888 | 4/1965 | King . | |
| D. 211,614 | 7/1968 | Warner . | |
| D. 215,373 | 9/1969 | Reimuller . | |
| D. 267,158 | 12/1982 | Lopez . | |
| D. 287,948 | 1/1987 | Evans . | |
| 1,616,604 | 2/1927 | Brophy | 340/907 |
| 2,228,835 | 1/1941 | Leppert | 340/84 |
| 3,688,259 | 8/1972 | Rebillet | 340/907 |
| 3,863,207 | 1/1975 | Galella | 340/907 |

*Primary Examiner*—Joseph A. Orsino
*Assistant Examiner*—Brian R. Tumm
*Attorney, Agent, or Firm*—Milton S. Gerstein

[57] ABSTRACT

A traffic signal control which is designed for color-blind persons, and has a unique geometric shape for the information to be conveyed. The traffic signal control has a central illuminated region of the specific geometric shape, bordered by an opaque region about which is provided a translucent track of white-light of the same geometric shape, which in turn is surrounded by another opaque strip of the same shape. When the control is for a "stop" signal, the central region is made of a red filter, and for the "go", it is made of a green filter. The white light is of a greater intensity than the light emanating from the central region, so that the color blind person may recognize the particular geometric shape indicative of that signal.

8 Claims, 2 Drawing Sheets

ILLUMINATED TRAFFIC SIGNAL FOR COLOR BLIND PERSONS

BACKGROUND OF THE INVENTION

The present invention is directed to a traffic control signal for color blind persons which allows color blind persons to discriminate between one signal and another, such as a red stop signal, a green go signal, a yellow caution signal, and so forth. Conventional, presently-used traffic control signals are not readily discernable by color blind persons, which means that a color blind person is not able to detect whether a red light or green light, or the like, is illuminated. Typically, a color blind person will react to a traffic control signal by reaction to those other vehicles in his vicinity, or may even have to guess as to the signal. Approximately 8% of all drivers are color blind. Furthermore, elderly people suffering from poor eyesight are also affected by currently used, conventional traffic control signals.

This problem has been recognized in the past, as for example U.S. Pat. No. 3,863,207. This patent shows a traffic control signal having a central illuminated portion surrounded by a track of amber light, with specified geometric shapes also being provided to provide discrimination between particular control signals. However, amber light is also not distinguishable by a color blind person, especially when directly above a red or green source of the same intensity, with relatively no division therebetween. Therefore, the traffic control signal of this patent offers little help to the color blind person.

SUMMARY OF THE INVENTION

It is, therefore, the primary objective of the present invention to provide an improved traffic control signal that is easily readable and distinguishable by a color blind person, while at the same time offering the usual conventional benefits to the non-color blind person.

It is another objective of the present invention to provide such a traffic control signal for color blind persons that is easily establishable into a standard symbol that may be used worldwide.

Towards these and other ends, the traffic control signal of the present invention is provided with a particular geometrical shape corresponding to the signal which it is to be connected with, with the interior region of the shape being illuminated in a conventional color, such as red for "stop", green for "go", yellow for "caution", etc. About this inner illuminated region there is provided a track of white light which is spatially divided and separated from the inner illuminated region by a preferably black border or strip. In the preferred embodiment the central region is illuminated by the color so desired in the conventional manner for indicating the usual control signal, but at an intensity less than that of the border region of illuminated white light. In a modification, the central illuminated region may be eliminated altogether and only the peripheral white light region illuminated, of course the border region having the same general geometric configuration as the central region. Any type of geometrical configuration may be chosen to represent any particular signal, such as circular for red, and diamond shaped for yellow, triangular for green, and the like. It is, of course, essential to the invention that the peripheral illuminated border region of white light be of greater intensity than the central region, or that there be no central region illuminated at all in order for the invention to properly achieve its objectives.

BRIEF DESCRIPTION OF THE DRAWING

The invention will be more readily understood with reference to the accompanying drawings, wherein.

DETAILED DESCRIPTION OF THE INVENTION

Figure 1:
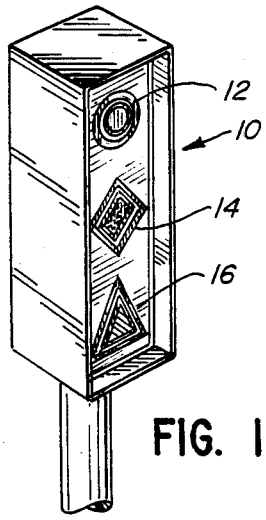
FIG. 1 is an isometric view of a typical traffic signal control box incorporated therein a plurality of traffic control signals made according to the present invention.
Figure 2:
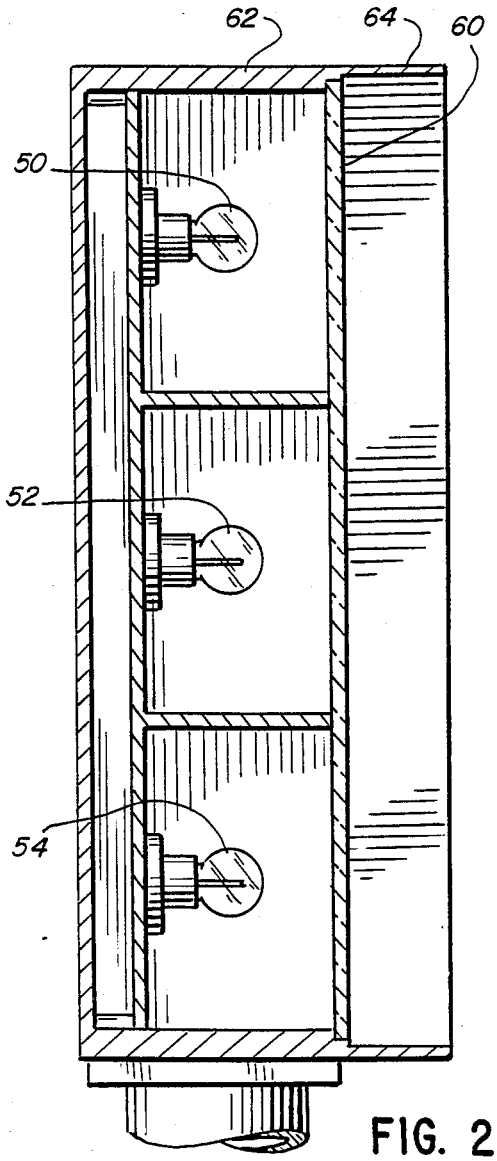
FIG. 2 is a cross sectional view taken along line 2—2 of FIG. 3, showing the traffic control signal box of FIG. 1 in detail.
Figure 3:
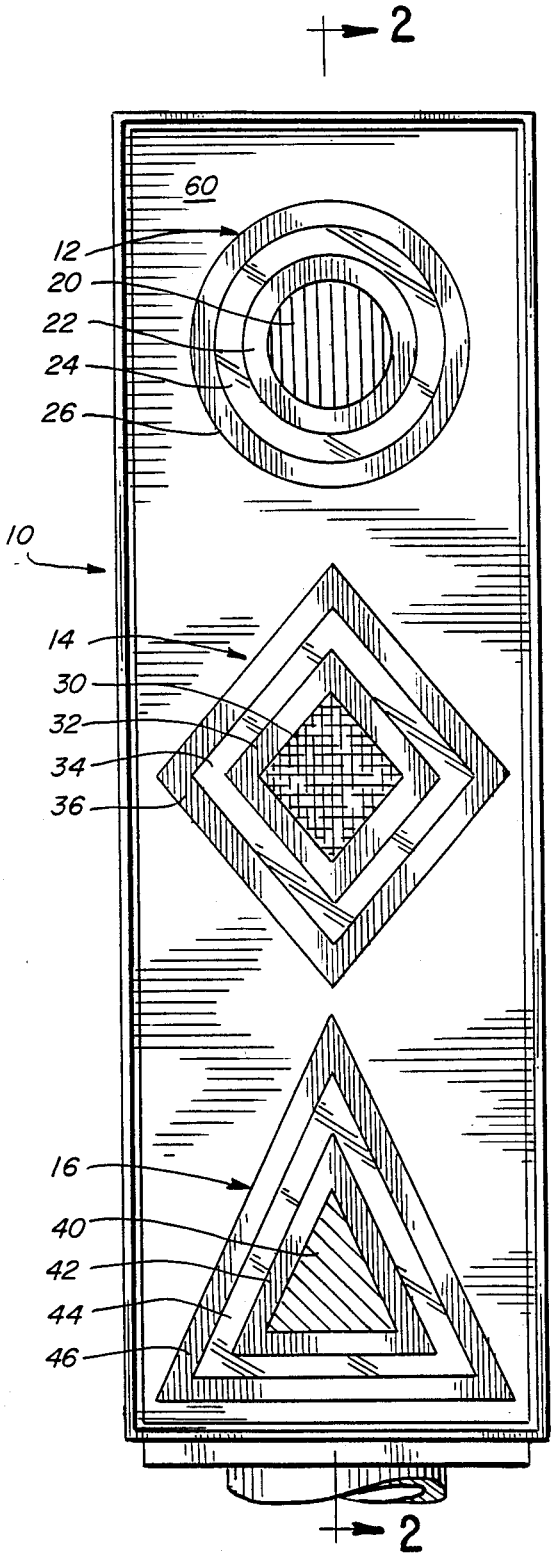
FIG. 3 is a front elevational view of the traffic control signal box of FIG. 1.

Referring now to the drawings in greater detail, and particularly to FIGS. 1 through 3, a traffic signal control box made according to the present invention is indicated generally by reference numeral 10. As can be clearly seen in FIGS. 1 and 3, the typical traffic control signal box 10 of the invention may be provided with three vertically spaced apart control signals 12, 14 and 16. The upper signal 12 is generally circular in shape and has an inner translucent red filter region 20 for indicating the "stop" signal. About this inner region 20 there is provided a similarly shaped, circular black border region 22. Concentric about this black, opaque border region 22 there is provided a clear or transparent or translucent, region 24 which is illuminated by the same source as that of the inner region 20, and defines a peripheral or circumferential border region of preferably pure white light, it having been discovered that to a color blind person only pure white light is that which is easily, most readily and unerroneously detected by him. There is also finally provided an outward-most circular black opaque border 26. Thus, the illuminated circular border of white light 24 is arranged between a pair of circular opaque, black strips to thereby enhance, highlight, and positively discriminate between the inner region of red light and the white light itself. According to the present invention, it is essential that the border or "halo" of white light 24 be of greater intensity than the intensity of the light emanating from the region 20, so that the region 24 will be readily discernable by the color blind person, which would not be the case if both regions 24 and 20 were of the same intensity or if region 20 were of greater intensity than the region 24. It is also within the scope of the present invention to do away with the central region 20 altogether.

The second or middle traffic control signal 14 is, as clearly shown in FIG. 2, diamond shaped and has a central region 30 of yellow translucent plastic or glass filter, which is surrounded by an outer diamond shaped black opaque border region 32. Concentric about this is a peripheral translucent plastic or glass region 34 similar to the region 24 but of diamond shape through which emanates the source of white light. The outwardmost diamond shaped border 36 also of black, opaque material, is provided similar to the region 26 of the signal 12. Thus, the second control signal 14 would represent the yellow caution light of a traffic control signal. As explained above, the region 34 must be of greater intensity than of the region 30. It is also noted that each of the opaque strips 32, 36, or 22, 26, may be achieved by any conventional method, such as by simple opaque black plastic strips, or adhesive strips, or the particular signal 12, 14, or 16, may be made from one sheet of plastic or glass with the regions above identified provided therein through any appropriate forming method.

The traffic control signal 16, like the signals 12 and 14 is provided with a central region 40 and an inner opaque black border region 42, a halo or transparent region 44 through which emanates the source of white light, and an outward-most opaque black border region 46. The shape of all of the regions of the signal 16 is triangular, with the central region 40 being a green filter lens, thus making the signal 16 a "go" signal. Everything above described with regards to the signals 12 and 14 also apply to the signal 16. As can be clearly seen in FIG. 2, each of the signals 12, 14, 16 is provided with its own light source 50, 52, and 54, respectively from which light source each of the described central regions 20, 30 and 40 as well as the halo regions 24, 34, and 44 are illuminated for visual sighting thereof from the outside. Preferably, each of the signals 12, 14, 16, is provided in a particular corresponding shape and formed in a main mounting panel 60, which mounts the signals 12, 14, 16 to the main housing 62 of the traffic signal box 10, also shown in FIG. 2. It is also preferable that the main housing 62 be provided with a forwardly projecting frame member 64 that projects outwardly beyond the mounting panel 60, in order to better direct the light rays. Preferably, the projecting frame 64 is rectangular like the traffic control box 10 itself. It is also within the scope and purview of the present invention to allow for additional framing of each signal 12, 14 and 16 individually by allowing for the forward projection of the respective outward-most opaque strips 26, 36, and 46, beyond the front surface plane of the panel 60. Conjoint therewith, the inner opaque region 22, 32, and 42 may also be forwardly raised or projected to thereby enhance the discrimination of the white light halo region 24, 34, and 44, in conjunction with the projecting rectangular frame 64.

It is also noted that the opaque strips 22, 26, 32, 36, 42, and 46, may be part of the panel 60 itself when such panel 60 is made of black or opaque material itself, thereby obviating the need for any separate additional work for the provision of these opaque strips. In the preferred embodiment, each of the white light tracks or halos 24, 34, 44, is preferably ¾ of an inch in width. Also, preferably, each of the opaque border strips are also ¾ of an inch in width. The central region 20 of signal 12 in the preferred embodiment is a 3½ inch diameter circle, while the region 30 of the amber signal 14 is a 3 inch square. In all of the signals above described the available surface in the preferred embodiment is that defined by a 4 inch radius circle or approximately 50 square inches, in which area the respective shape and regions of the signal are formed.

Figure 4:
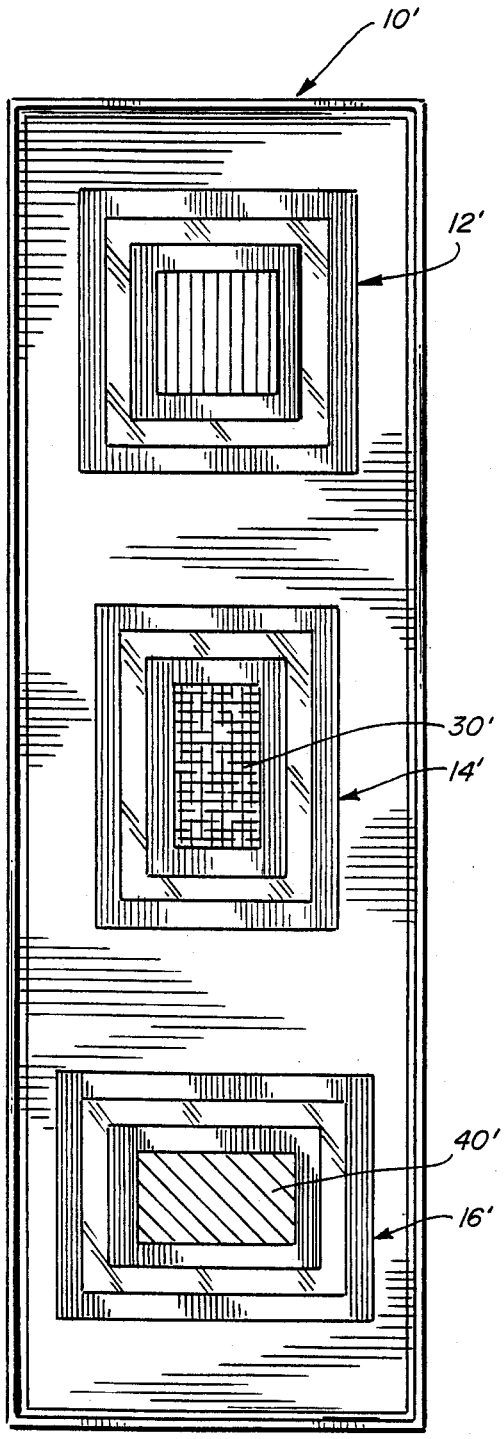
FIG. 4 is a modification of the traffic signal control box of FIG. 1, in which there are provided different geometrical shapes as compared to those shown in FIG. 1.

The modification of the traffic control signal box is shown in FIG. 4 and indicated generally by reference numeral 10'. Basically, the differences are in geometrical shape only. The red signal 12' is a square shaped element, with the plurality of regions above identified for the traffic control signal box 10 being the same. The middle signal 14', for the amber light is essentially a vertical rectangle, while the lower signal 16' for the go signal is a horizontal rectangular shape. In the preferred embodiment the horizontal rectangle 16' is 5 inches by 10 inches with each of the border strips having a width of ½ inch, thus leaving a central region 40' 2 inches by 7 inches. The central region 30' of the signal 14' is also 2 inches by 7 inches, with the entire signal 14' also occupying a space of 5 inches by 10 inches.

Figure 5:
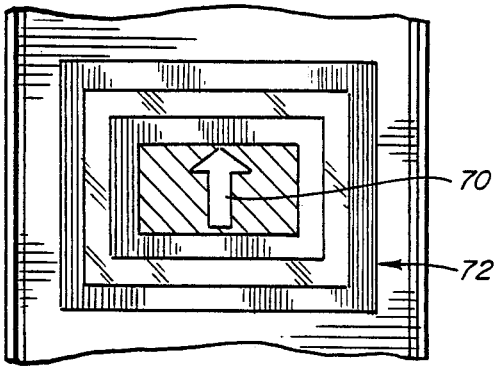
FIG. 5 is another modification of the invention showing an illuminated arrow of a traffic signal control box made according to the present invention.
Figure 6:
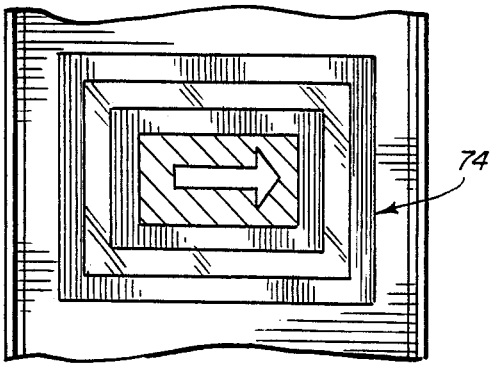
FIG. 6 is another modification of a traffic signal control box showing a right turn arrow made according to the present invention.
Figure 7:
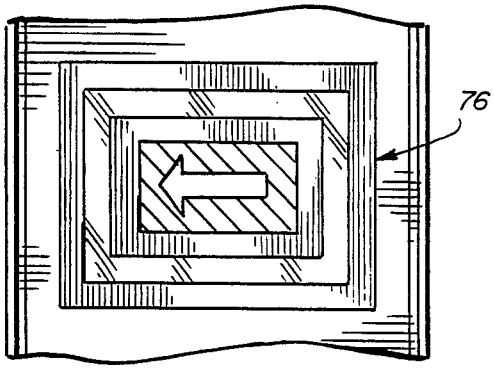
FIG. 7 is yet another modification of a traffic signal control box of the invention showing an illuminated left hand turn indicator.

FIGS. 5, 6 and 7 show additional alternatives to the signals that may be used, for the go signal. In FIG. 5 a straight arrow 70 is formed in the central region of the control signal 72, with the remaining border regions being as above described. The arrow 70 may constitute the only illuminated portion of the central region thereof, in the conventional fashion. FIG. 6 shows a control signal 74 similar to the control signal 72 but with a right angle arrow shown for use in right turns only. FIG. 7 shows control signal 76 having a central region with a left turn arrow for left turn only signals. Each of the control signals 72, 74 and 76 is provided with a pair of opaque border regions sandwiching therebetween a respective white light track or halo of white light as above described. In each of the control signals 72, 74, 76 it is again essential that each of the central regions thereof of particular color be of less intensity than the white light track associated therewith as above described. While it has been shown that the inner region of the signal 72 is a horizontal rectangle, as well as each of the other regions for the signal 74 and 76, it is to be understood that such is only by way of example. For example, a horizontal rectangle may be used to indicate straight arrow 70 while the modification thereof may be used to indicate a right turn arrow, a left turn arrow, etc, as long as the same shape is used to represent and be associated with a particular control signal. Thus, the present invention has applicability on a worldwide scale and is totally free and unhindered by language. However, since the two colors that are the most difficult for a color blind person to discriminate, namely red and green, are those very colors which currently make up the two most important signals of conventional traffic signal control boxes, it is preferred that the green signal be triangular in shape while the red one be circular, since such offers a greater degree of geometrical discrimination to the ambient surroundings.

While a specific embodiment of the invention has been shown and described, it is to be understood that numerous changes and modifications thereof may be made without departing from the scope, the spirit, and intent of the invention as set forth in appended claims. The intensity of the white light track is preferably between 1.5 and 10 times the intensity of the central region of the respective control signal. Furthermore, it is essential the track of white light be only white light and not amber, since amber is not visible or discernible to the color-blind person.

What is claimed is:

1. A traffic control signal comprising:

a main housing;

illuminating means in said main housing comprising a light source;

a control signal panel mounted to a front portion of said main housing;

control signal means in said panel comprising a first central region of a specified geometrical shape, a first opaque border region surrounding said central region and having the same geometrical shape as said central region, an illuminated track region through which emanates light from said light source of said illuminating means, said light being white light, and a second opaque border region surrounding said track region, said first and second opaque border regions sandwiching therebetween said track region, each of said second opaque region and said track region also being and the same geometrical shape as said central region and each having substantially the same width;

said track region being of greater light intensity as compared with said central region, whereby said track region may be used by a color blind person.

2. A traffic control signal comprising:

a main housing;

illuminating means in said main housing comprising a light source;

a control signal panel mounted to a front portion of said main housing;

control signal means in said panel comprising a central region of a specified geometrical shape, a first opaque border region surrounding said central region and having the same geometrical shape as said central region, an illuminated track region through which emanates light from said light source of said illuminating means, said light being white light, and a second opaque border region surrounding said track region, said first and second opaque border regions sandwiching therebetween said track region, each of said second opaque region and said track region also being of the same geometrical shape as said central region;

said track region being of at least 1.5 times the light intensity as said central region, whereby said track region may be used by a color blind person;

said central region comprising a translucent filter means of a specified color different from white light to indicate to color-sighted persons a conventional signal control response;

each of said first and second opaque border regions and said track region having a width of between $\frac{3}{8}$ of an inch and one inch.

3. The traffic control signal according to claim 2, wherein said filter means is a red filter, and aid geometrical shape of said central region is circular.

4. The traffic control signal according to claim 2, wherein said filter means is a green filter, and said geometrical shape of said central region is triangular.

5. The traffic control signal according to claim 2, wherein said control signal means occupies an area of approximately 50 square inches, in which area said central region, said first and second opaque regions, and said track region are situated.

6. The traffic control signal according to claim 5, wherein said central region is substantially circular in shape, and has a radius of $3\frac{1}{2}$ inches, each of said first and second opaque regions and track region having a width of approximately $\frac{3}{4}$ of an inch.

7. The traffic control signal according to claim 5, wherein said central region is substantially 3 inch square diamond shape, and each of said first and second opaque regions and track region having a width of $\frac{3}{4}$ of an inch.

8. The traffic control signal according to claim 2, wherein said filter means is a vertical rectangle, and comprises an amber filter.

* * * * *